US006273046B1

(12) United States Patent
Pierce

(10) Patent No.: US 6,273,046 B1
(45) Date of Patent: Aug. 14, 2001

(54) VALVE SPRING RETAINER WITH SKIRT

(76) Inventor: Daniel H. Pierce, 1330 Lyonhurst, Birmingham, MI (US) 48009

( * ) Notice: Subject to any disclaimer, the term of this patent is extended or adjusted under 35 U.S.C. 154(b) by 0 days.

(21) Appl. No.: 09/360,933

(22) Filed: Jul. 26, 1999

(51) Int. Cl.[7] ..... F01L 3/10
(52) U.S. Cl. ..... 123/90.67
(58) Field of Search ..... 123/90.67, 90.65, 123/90.66, 188.12, 188.13, 188.17; 251/337; 29/215, 249

(56) References Cited

U.S. PATENT DOCUMENTS

| | | | | |
|---|---|---|---|---|
| 4,879,978 | | 11/1989 | Pierce | 123/90.67 |
| 5,143,351 | | 9/1992 | Pierce | 251/337 |
| 5,226,229 | | 7/1993 | Pierce | 29/215 |
| 5,255,640 | | 10/1993 | Pierce | 123/90 |
| 5,275,376 | * | 1/1994 | Rich | 251/337 |
| 5,293,848 | | 3/1994 | Rich et al. | 123/90.67 |

* cited by examiner

*Primary Examiner*—Teresa Walberg
*Assistant Examiner*—Vinod D Patel
(74) *Attorney, Agent, or Firm*—Howard & Howard

(57) ABSTRACT

The valve stem (20) extends through the ring (56) and the hole (52) in the flange (50) of a retainer (30) and a spring (28) surrounds the stem (20) and engages the flange (50) in the axial direction and a skirt portion (60) in the radial direction. The retainer (30) is characterized by the skirt portion (60) having a waist diameter (W) and first and second annular extending surfaces (62 and 64) respectively extending axially in opposite directions from the waist diameter (W) at an included waist angle of less than 180° relative to one another as the skirt portion (60) is viewed in cross section. The root diameter (R) is larger than the waist diameter (W) and the root diameter (R) is also larger than the distal end diameter (D), but the distal end diameter (D) is larger than the waist diameter (W). The distal end diameter (D) and the ring (56) are radially aligned, i.e., aligned horizontally, and the skirt portion (60) is spaced radially from the ring (56) to define a void or recess (66) therebetween. A spoke (68) extends radially between the ring (56) and the skirt portion (60) in each of three sectors (S).

10 Claims, 4 Drawing Sheets

VALVE SPRING RETAINER WITH SKIRT

BACKGROUND OF THE INVENTION

1. Field of the Invention

The subject invention relates to a valve spring retainer for operatively retaining a return spring on the stem of a poppet valve in an internal combustion engine.

2. Description of the Prior Art

The use of valve spring retainers in internal combustion engines is well known. Self locking retainers are known wherein the retainer automatically locks on the valve stem as the retainer is pressed onto the valve stem by reaction with the spring during operation. Such a retainer typically includes a retainer flange extending annularly about a hole on a central axis for engaging the top of a spring. A ring is disposed below the flange and extends about the axis for surrounding a valve stem. An inner portion extends cylindrically about the axis and axially between the ring and the flange. A skirt portion is spaced radially from and extends cylindrically about the inner portion and depends axially from a root diameter adjacent the flange to a distal end diameter. A plurality of slots extend radially from the hole and divide the flange and the portions into sectors leaving the ring to interconnect the sectors. During operation the spring reacts against a retainer flange and urges the sectors to rotate into engagement with the stem to lock onto the stem. The spring is centered by the skirt. Such assemblies are shown in U.S. Pat. No. 5,293,848 to Rich et al and applicant's previous U.S. Pat. NoS. 4,879,978; 5,143,351; 5,226,229; and 5,255,640. Although these prior retainers function well there remains a requirement for a retainer wherein the radially engagement between the retainer and the spring is closely controlled.

SUMMARY OF THE INVENTION AND ADVANTAGES

A valve spring retainer for operatively retaining a return spring on a stem of a poppet valve in an internal combustion engine. The retainer comprises a retainer flange extending annularly about a hole on a central axis for engaging the top of a spring, a ring disposed below the flange and extending about the axis for surrounding a valve stem, and an inner portion extending cylindrically about the axis and axially between the ring and the flange. A skirt portion is spaced radially from and extends cylindrically about the inner portion and depends axially from a root diameter adjacent the flange to a distal end diameter. A plurality of slots extend radially from the hole and divide the flange and the portions into sectors leaving the ring to interconnect the sectors. The retainer is characterized by the skirt portion having a waist diameter and first and second surfaces extending axially from the waist diameter at an included waist angle of less than 180° relative to one another as the skirt portion is viewed in cross section.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
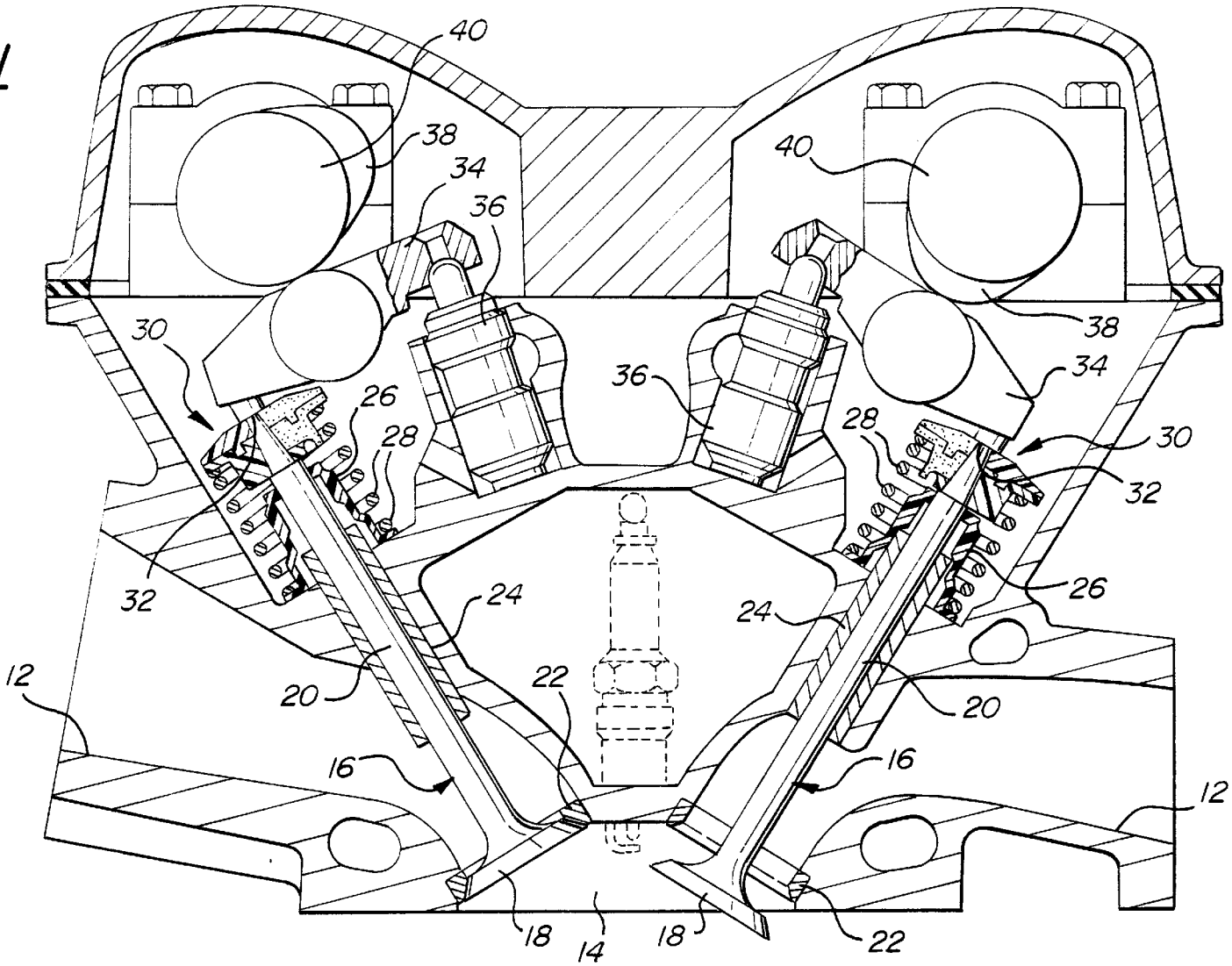
FIG. 1 is a cross sectional view showing a retainer incorporating the subject invention installed in an internal combustion engine.
Figure 2:
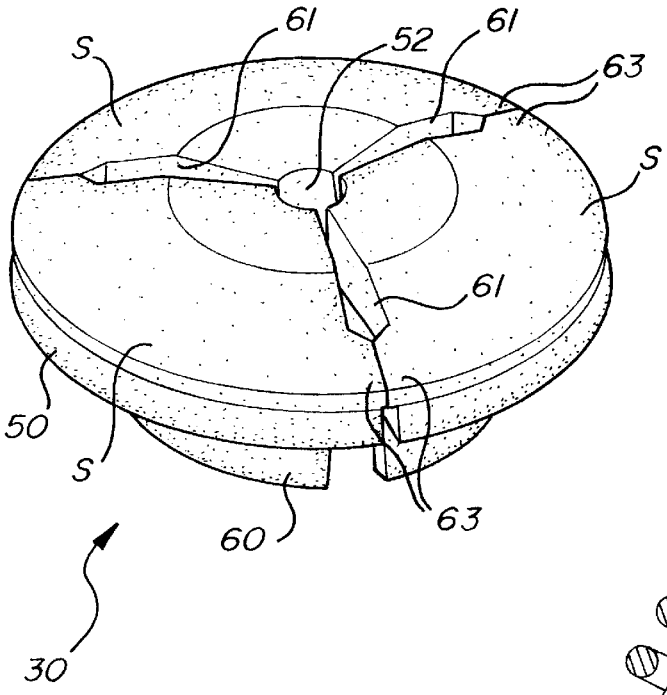
FIG. 2 is a perspective view of a retainer incorporating the subject invention in the operating position.
Figure 3:
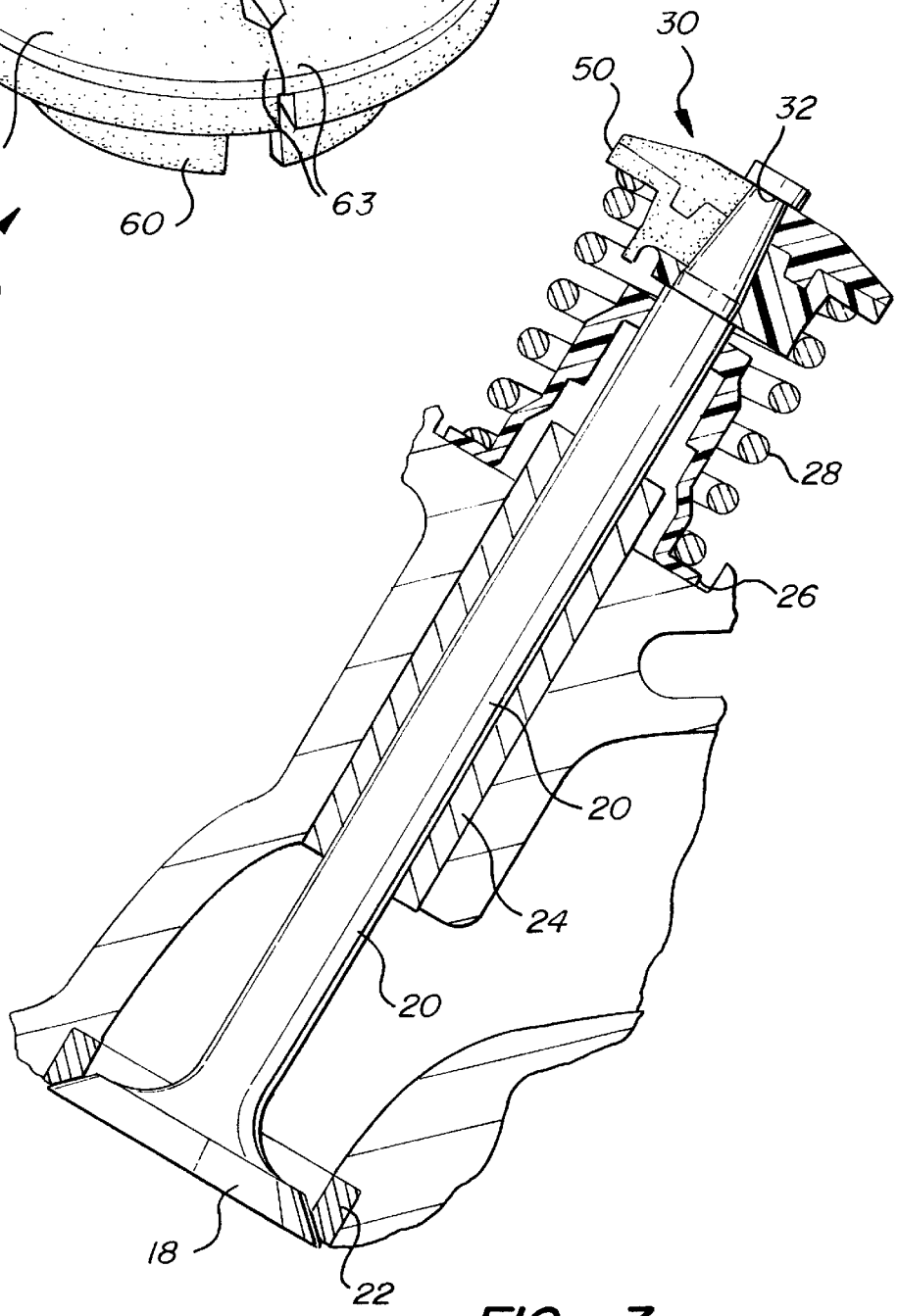
FIG. 3 is an enlarged fragmentary and cross sectional view of one valve assembly illustrated in FIG. 1.
Figure 5:
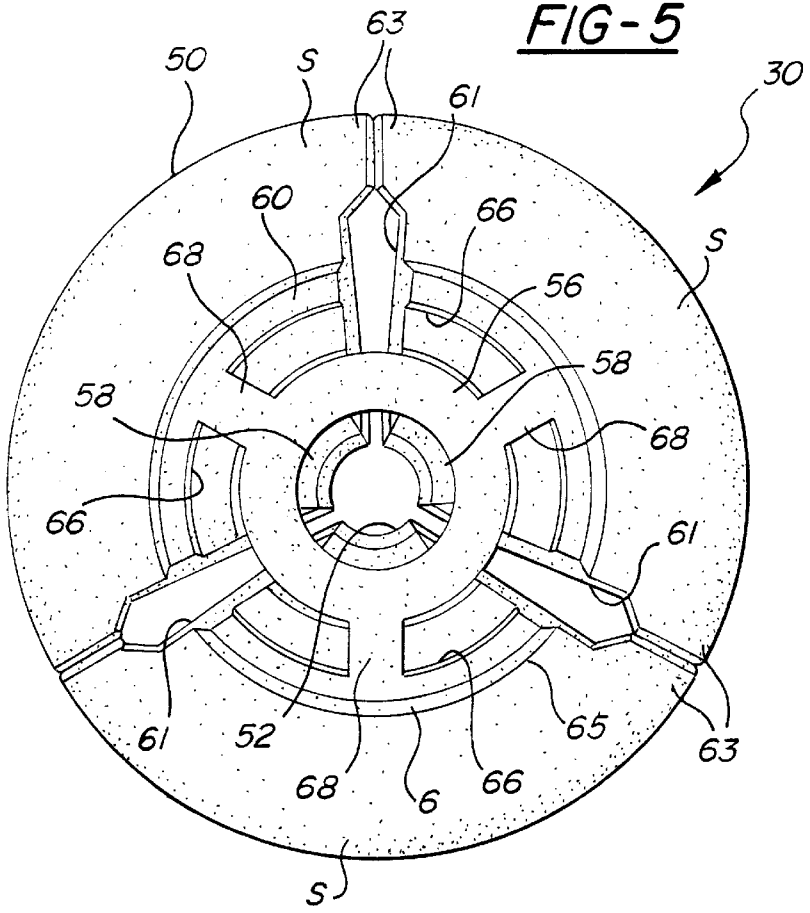
FIG. 5 is a bottom view of the retainer of FIG. 2.
Figure 4:
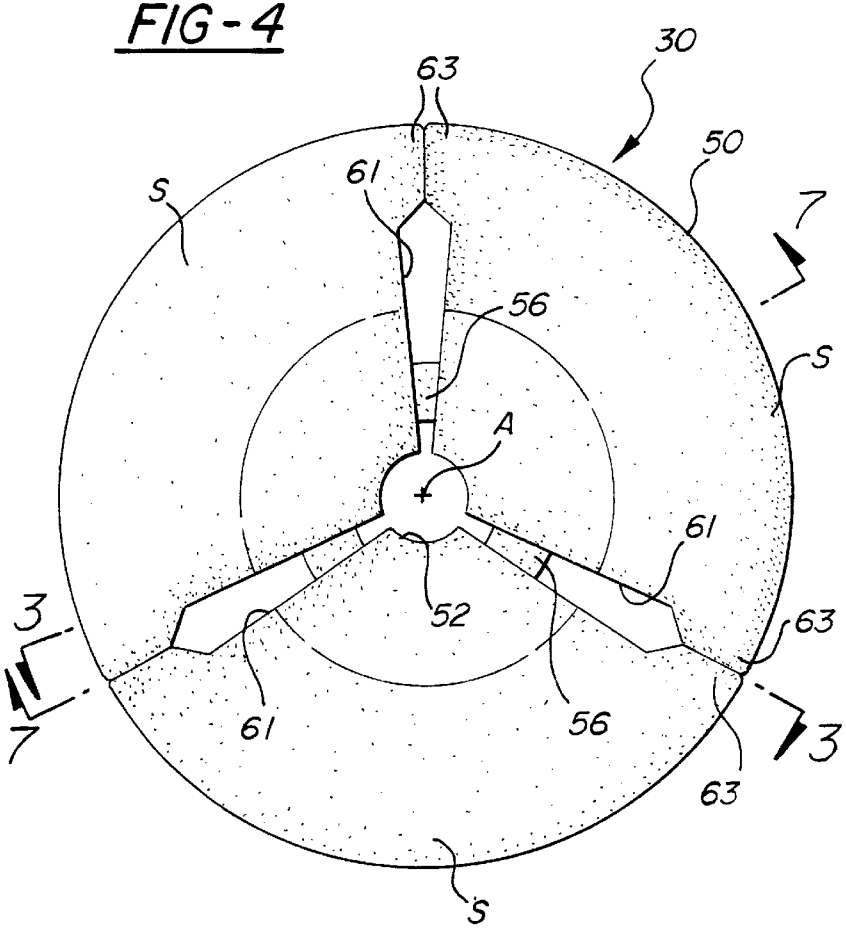
FIG. 4 is a top view of the retainer of FIG. 2 in the operating position.
Figure 6:
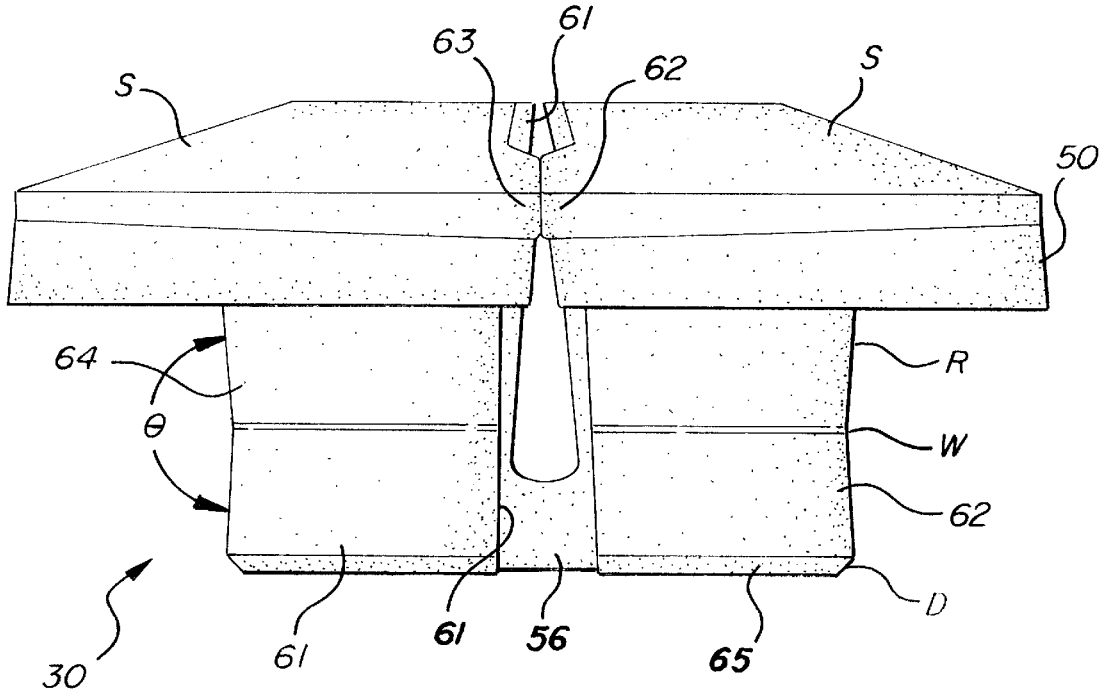
FIG. 6 is an enlarged side view of the retainer of FIG. 2.

Referring to the Figures, wherein like numerals indicate like or corresponding parts throughout the several views, a head in a typical internal combustion engine is shown in FIG. 1. The cylinder head includes intake ports 12 extending into a combustion chamber 14. A pair of intake valves, generally indicated at 16, each include a valve head and a valve stem 20. The valve heads engage the valve seats 22 and the valve stem 20 is slidably supported in a valve guide 24, which is retained in the cylinder head by a press fit. A plastic seal 26 covers the upper end of the valve guide 24 and engages the stem 20 in a boot-like manner for wiping oil from the valve stem 20. A return spring 28 is disposed concentrically about the valve stem 20 and extends axially from the bottom flange on the seal 26 to a self locking spring retainer constructed in accordance with the subject invention and generally shown at 30.

The valve stem 20 extends above the retainer 30 and engages a rocker arm 34 and includes a recess or undercut 32. The rocker arm engages a hydraulic adjustor 36 and is rotated by a lobe 38 on a cam shaft 40. As the lobe 38 rotates away from the rocker arm 34, the return spring 28 acts against the retainer 30 to urge the retainer 30 into locking engagement with the undercut or recess 32 in the valve stem 20, which, in turn, urges the valve head 18 into sealing engagement with the valve seat 22, all of which is well known in the prior art. The valve spring retainer 30 operatively retains the return spring 28 on the stem 20 of the poppet valve 16.

The retainer 30 is an integral member comprising a retainer flange 50 extending annularly about a hole 52 on a central axis A for engaging the top of the spring 28. The hole 52 is tapered or is conical, having a larger diameter adjacent the bottom and a smaller diameter adjacent the top. The hole 52 engages a taper below the undercut or recess 32 in the valve stem 20.

The retainer 30 is molded of two different plastic materials which bond together and include a plurality of lugs 54 which mechanically interconnect the two materials, which is described in the aforementioned U.S. Pat. No. 5,255,640.

A ring 56 is disposed below the flange 50 and extends about the axis A for surrounding the valve stem 20. An inner portion 58 extends cylindrically about the axis A and axially between the ring 56 and the flange 50. A skirt portion 60 is spaced radially from and extends cylindrically about the inner portion 58 and depends axially from a root diameter R adjacent the flange 50 to a distal end diameter D. A plurality of slots 61 extend radially from the hole 52 and divide the flange 50 and the portions 58 and 60 into sectors S leaving the ring 56 to interconnect the sectors S. The slots 61 extend radially at a wide width and narrow to a limit projection 63 at the periphery of each of the sectors S to define a narrow width whereby the limit projections 63 limit relative annular rotation between the sectors S.

The retainer 30 is characterized by the skirt portion 60 having a waist diameter W and first and second annular extending surfaces 62 and 64 respectively extending axially in opposite directions from the waist diameter W at an included waist angle Θ of less than 180° relative to one another as the skirt portion 60 is viewed in cross section. In other words, the annular surface 62 extends axially between the waist diameter W and the distal end diameter D and the annular surface 64 extends axially between the waist diameter W and the root diameter R. Furthermore, the root diameter R is larger than the waist diameter W. the root diameter R is also larger than the distal end diameter D, but the distal end diameter D is larger than the waist diameter W. The first surface 62 is frusto-conical to increase in diameter from the waist diameter W to the root diameter R and the second surface 64 is frusto-conical to increase in diameter from the waist diameter W to the distal end diameter D. The distal end diameter D is disposed at a beveled surface 65 which extends to the end surface of the skirt 60.

Figure 7:
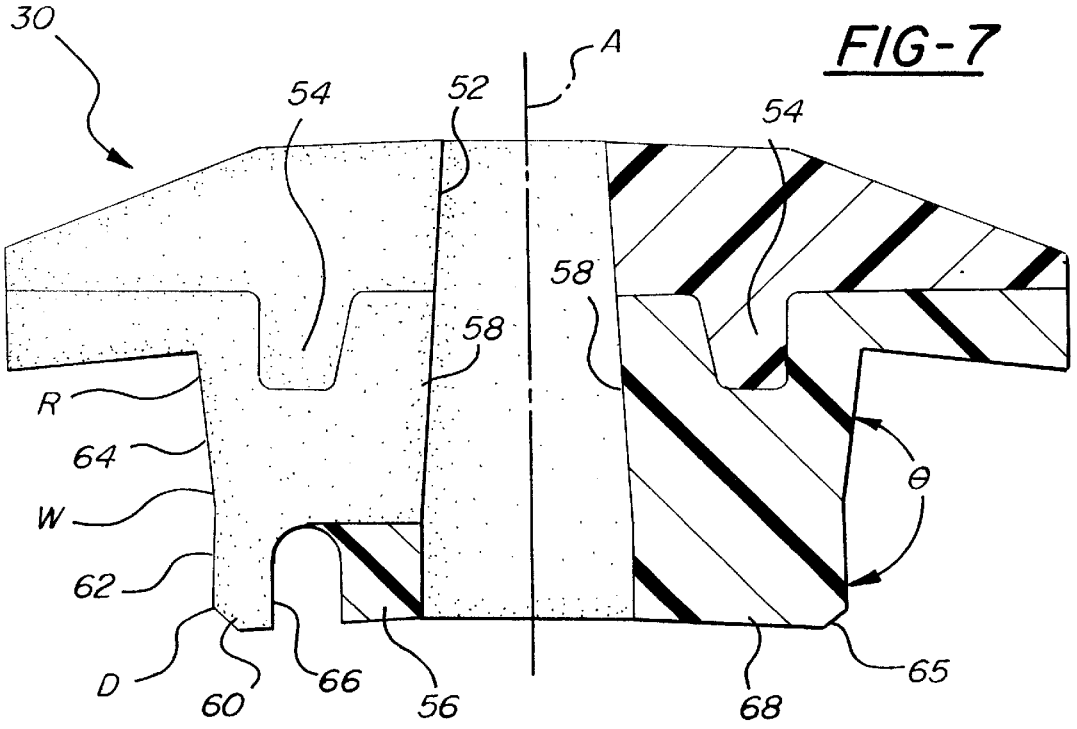
FIG. 7 is an enlarged cross sectional view taken along line 7—7 of FIG. 4.

The distal end diameter D and the ring 56 are radially aligned, i.e., aligned horizontally as best viewed in FIG. 7. The skirt portion 60 is spaced radially from the ring 56 to define a void or recess 66 therebetween. A spoke 68 extends radially between the ring 56 and the skirt portion 60 in each of the sectors S, of which there are three, each sector extending annularly through 120°.

The valve stem 20 extends through the ring 56 and the hole 52 in the flange 50 and a spring 28 surrounds the stem 20 and engages the flange 50 in the axial direction and the skirt portion 60 in the radial direction. The spring 28 includes a plurality of convolutions defining an inner diameter and the distal end diameter D is larger than the inner diameter of the spring 28 to form an interference fit.

The invention has been described in an illustrative manner, and it is to be understood that the terminology which has been used is intended to be in the nature of words of description rather than of limitation.

Obviously, many modifications and variations of the present invention are possible in light of the above teachings and the invention may be practiced otherwise than as specifically described within the scope of the appended claims, wherein that which is prior art is antecedent to the novelty set forth in the, "characterized by" clause. The novelty is meant to be particularly and distinctly recited in the "characterized by" clause whereas the antecedent recitations merely set forth an old and well known combination in which the invention resides and these antecedent recitations should be interpreted to cover any combination in which the inventive novelty has utility. In addition, the reference numerals are merely for convenience and are not to be in any way to be read as limiting.

What is claimed:

1. A valve spring retainer (30) for operatively retaining a return spring (28) on a stem (20) of a poppet valve in an internal combustion engine, said retainer (30) comprising;

a retainer flange (50) extending annularly about a hole (52) on a central axis for engaging the top of a spring (28), a ring (56) disposed below said flange (50) and extending about said axis for surrounding a valve stem (20), an inner portion (58) extending cylindrically about said axis and axially between said ring (56) and said flange (50), a skirt portion (60) spaced radially from and extending cylindrically about said inner portion (58) and depending axially from a root diameter (R) adjacent said flange (50) to a distal end diameter (D), a plurality of slots (61) extending radially from said hole (52) and dividing said flange (50) and said portions into sectors (S) leaving said ring (56) to interconnect said sectors (S), said retainer (30) characterized by said skirt portion (60) having a waist diameter (W) and first and second surfaces extending axially from said waist diameter (W) at an included waist angle (O) of less than 180° relative to one another as said skirt portion (60) is viewed in cross section.

2. A retainer (30) as set forth in claim 1 further characterized by said root diameter (R) being larger than said waist diameter (W).

3. A retainer (30) as set forth in claim 2 further characterized by said root diameter (R) being larger than said distal end diameter (D).

4. A retainer (30) as set forth in claim 3 further characterized by said distal end diameter (D) being larger than said waist diameter (W).

5. A retainer (30) as set forth in claim 1 wherein said distal end diameter (D) and said ring (56) are radially aligned.

6. A retainer (30) as set forth in claim 5 wherein said skirt portion (60) is spaced radially from said ring (56) to define a void (66) therebetween.

7. A retainer (30) as set forth in claim 6 including a spoke (68) extending radially between said ring (56) and said skirt portion (60) in each of said sectors (S).

8. A retainer (30) as set forth in claim 7 including three of said sectors (S), each sector extending annularly through 120°.

9. A retainer (30) as set forth in claim 1 including a valve stem (20) extending through said ring (56) and said hole (52) in said flange (50), a spring (28) surrounding said stem (20) and engaging said flange (50) in the axial direction and said skirt (60) in the radial direction.

10. A retainer (30) as set forth in claim 9 wherein said spring (28) includes a plurality of convolutions defining an inner diameter and said distal end diameter (D) is larger than said inner diameter of said spring (28) to form an interference fit.

* * * * *